US008448481B2

(12) United States Patent
Park et al.

(10) Patent No.: US 8,448,481 B2
(45) Date of Patent: May 28, 2013

(54) PULSATOR UNIT FOR WASHING MACHINE AND WASHING MACHINE HAVING THE SAME

(75) Inventors: Jae Ryong Park, Hwaseong-si (KR); Sang Yeon Pyo, Suwon-si (KR); Byoung Yull Yang, Hwaseong-si (KR); Hwang Mook Cho, Hwaseong-si (KR); Dong Pil Seo, Suwon-si (KR); So Jung Yu, Suwon-si (KR); Bo Kyung Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 473 days.

(21) Appl. No.: 12/654,971

(22) Filed: Jan. 11, 2010

(65) Prior Publication Data

US 2010/0175434 A1 Jul. 15, 2010

(30) Foreign Application Priority Data

Jan. 15, 2009 (KR) ..... 10-2009-0003246

(51) Int. Cl.
*D06F 13/00* (2006.01)

(52) U.S. Cl.
CPC ..... *D06F 13/00* (2013.01)
USPC ..... 68/133; 68/134

(58) Field of Classification Search
CPC ..... D06F 13/00; D06F 13/06
USPC ..... 68/133, 134
See application file for complete search history.

(56) References Cited

U.S. PATENT DOCUMENTS

| | | | | | |
|---|---|---|---|---|---|
| 1,712,755 | A | * | 5/1929 | Dietenberger | 68/54 |
| 1,756,318 | A | * | 4/1930 | Voss | 68/133 |
| 1,795,395 | A | * | 3/1931 | Hoke | 68/134 |
| 2,075,628 | A | * | 3/1937 | Sekavec | 68/54 |
| 2,119,677 | A | * | 6/1938 | Labisky | 68/4 |
| 2,145,453 | A | * | 1/1939 | Miller | 68/28 |
| 2,145,454 | A | * | 1/1939 | Miller | 68/28 |
| 2,186,786 | A | * | 1/1940 | Jensen | 74/18.1 |
| 2,208,102 | A | * | 7/1940 | Nelson | 68/54 |

(Continued)

FOREIGN PATENT DOCUMENTS

| | | |
|---|---|---|
| CN | 1200416 | 12/1998 |
| CN | 1438379 | 8/2003 |

(Continued)

OTHER PUBLICATIONS

Chinese Office Action mailed May 3, 2012 issued in corresponding Chinese Patent Application No. 201010003915.X

*Primary Examiner* — Joseph L Perrin
(74) *Attorney, Agent, or Firm* — Staas & Halsey LLP

(57) ABSTRACT

In the washing machine, which has a tub installed in a main body, a spin basket rotatably installed in the tub, and a pulsator unit installed in the spin basket to generate a washing water current, the pulsator unit includes a first pulsator connected to a washing shaft of a driving device, a rod member installed on the upper surface of the first pulsator such that the rod member is tilted toward a central axis of the first pulsator at a designated angle, and a second pulsator coupled with the rod member such that the second pulsator is relatively rotated against the rod member. The pulsator unit generates a combined water current in the spin basket, and thus prevents the twisting and entanglement of laundry or reduces the amount of consumed washing water.

18 Claims, 7 Drawing Sheets

U.S. PATENT DOCUMENTS

| | | | | | |
|---|---|---|---|---|---|
| 2,567,509 | A | * | 9/1951 | Davis | 366/306 |
| 2,645,111 | A | * | 7/1953 | Fields | 68/23.6 |
| 2,695,510 | A | * | 11/1954 | Kendall | 68/23.6 |
| 2,715,826 | A | * | 8/1955 | Kirby | 68/23.6 |
| 2,802,356 | A | * | 8/1957 | Kirby | 68/23.3 |
| 2,831,333 | A | * | 4/1958 | Smith | 68/131 |
| 2,902,851 | A | * | 9/1959 | Fields | 68/131 |
| 2,921,460 | A | * | 1/1960 | Aberle | 68/131 |
| 2,924,086 | A | * | 2/1960 | Fields | 68/23.6 |
| 2,990,709 | A | * | 7/1961 | Bochan | 68/131 |
| 5,176,012 | A | * | 1/1993 | Oh et al. | 68/21 |
| 5,231,857 | A | * | 8/1993 | Rew et al. | 68/134 |
| 5,651,278 | A | * | 7/1997 | Pinkowski | 68/134 |
| 5,765,406 | A | * | 6/1998 | Youn | 68/134 |
| 5,791,167 | A | * | 8/1998 | Wyatt et al. | 68/134 |
| 6,115,863 | A | * | 9/2000 | Mason et al. | 8/159 |
| 6,865,912 | B2 | * | 3/2005 | Kim | 68/133 |

FOREIGN PATENT DOCUMENTS

| | | | |
|---|---|---|---|
| CN | 200971430 | * | 11/2007 |
| JP | 64-022286 | * | 1/1989 |
| JP | 2003-190687 | * | 7/2003 |
| KR | 20-1995-27560 | | 11/1996 |
| KR | 20-1998-031931 | | 8/1998 |
| KR | 10-2003-0068345 | | 8/2003 |
| KR | 10-2004-0058726 | | 7/2004 |

* cited by examiner

PULSATOR UNIT FOR WASHING MACHINE AND WASHING MACHINE HAVING THE SAME

CROSS-REFERENCE TO RELATED APPLICATIONS

This application claims the benefit of Korean Patent Application No. 2009-0003246, filed on Jan. 15, 2009, in the Korean Intellectual Property Office, the disclosure of which is incorporated herein by reference

BACKGROUND

1. Field

Embodiments of the present invention relate to a pulsator unit for washing machines, which generates a combined current of washing water, and a washing machine having the same.

2. Description of the Related Art

In general, a washing machine includes a tub to contain washing water, a spin basket rotatably installed in the tub, a pulsator installed in the spin basket to agitate the washing water and the laundry, a motor serving as a driving unit to rotate the spin basket and the pulsator, and a power transmission device including a belt to selectively transmit the rotary force of the motor to the spin basket and the pulsator. These parts of the washing machine are provided in a housing forming the external appearance of the washing machine.

In the washing machine, a washing course, a rinsing course, and a dehydrating course are automatically carried out under the predetermined control of a control unit. In the washing course, after the spin basket is filled with washing water containing laundry under the condition that the laundry is put into the spin basket, the pulsator is repeatedly rotated in a regular direction and the reverse direction by the driving of the motor such that the washing of the laundry is achieved.

However, the above-operated washing machine washes the laundry using a washing water current generated by alternately repeating the regular and reverse rotations of the pulsator, and thereby the laundry alternately moves in the regular direction and the reverse direction and is twisted and entangled, and thus is damaged.

In order to solve the above problem, a washing machine having a pulsator, which generates a water current flowing up and down rather than a simple water current rotated right and left, has been developed.

SUMMARY

Therefore, it is an aspect of the present invention to provide a pulsator unit for washing machines, which generates a combined water current through a simple mechanical structure, and a washing machine having the same.

Additional aspects of the invention will be set forth in part in the description which follows and, in part, will be apparent from the description, or may be learned by practice of the invention.

In accordance with one aspect, a pulsator unit for washing machines to generate a washing water current includes a first pulsator, a rod member installed on the upper surface of the first pulsator such that the rod member is tilted at a designated angle, and a second pulsator shaft-coupled with the rod member such that the second pulsator is relatively rotated against the rod member.

The first pulsator may generate a rotating water current, and the second pulsator may generate a rising and falling water current.

The rod member may be tilted toward a central axis of the first pulsator.

The center of the wobbling movement of the second pulsator may be formed at the intersection between the central axis of the first pulsator and a central axis of the rod member.

A bearing part may be formed on the rod member.

A bearing hole contacting the bearing part may be formed on the second pulsator.

A support member to support the second pulsator and pass the rod member may be provided at the center of the first pulsator, and the bearing part may be formed at a part protruding from the support member.

The second pulsator may include a rod connection part provided with a bearing hole, into which the rod member is inserted, and a blade part extended from the outer surface of the rod connection part.

Reinforcing ribs to reinforce the stiffness of the blade part may be provided on the second pulsator.

The rod connection part may have a spherical shape.

A support member provided with a seat part having a semispherical shape to support the rod connection part may be provided at the center of the first pulsator.

Roller members may be provided on the blade part.

The diameter of the second pulsator may be smaller than that of the first pulsator.

The center of the wobbling movement of the second pulsator may be separated from the central axis of the first pulsator by a designated distance.

In accordance with another aspect, a washing machine includes a tub installed in a main body to contain washing water, a spin basket rotatably installed in the tub, and a pulsator unit installed in the spin basket to generate a washing water current, the pulsator unit including a first pulsator connected to a washing shaft of a driving device, a rod member installed on the upper surface of the first pulsator such that the rod member is tilted toward a central axis of the first pulsator at a designated angle, and a second pulsator coupled with the rod member such that the second pulsator is relatively rotated against the rod member.

A bearing part may be formed on the rod member, and a bearing hole contacting the bearing part may be formed on the second pulsator.

The second pulsator may include a rod connection part provided with the bearing hole, and a blade part extended from the outer surface of the rod connection part.

The center of the wobbling movement of the second pulsator may be formed at the intersection between the central axis of the first pulsator and a central axis of the rod member.

The center of the wobbling movement of the second pulsator may be separated from the central axis of the first pulsator by a designated distance.

A support member to support the rod connection part may be provided at the center of the first pulsator.

The rod connection part may have a spherical shape, and a seat part having a semispherical shape, on which the rod connection part is seated, may be provided on the upper surface of the support member.

The blade part may be perpendicular to a central axis of the rod member.

Roller members may be provided on the blade part of the second pulsator.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
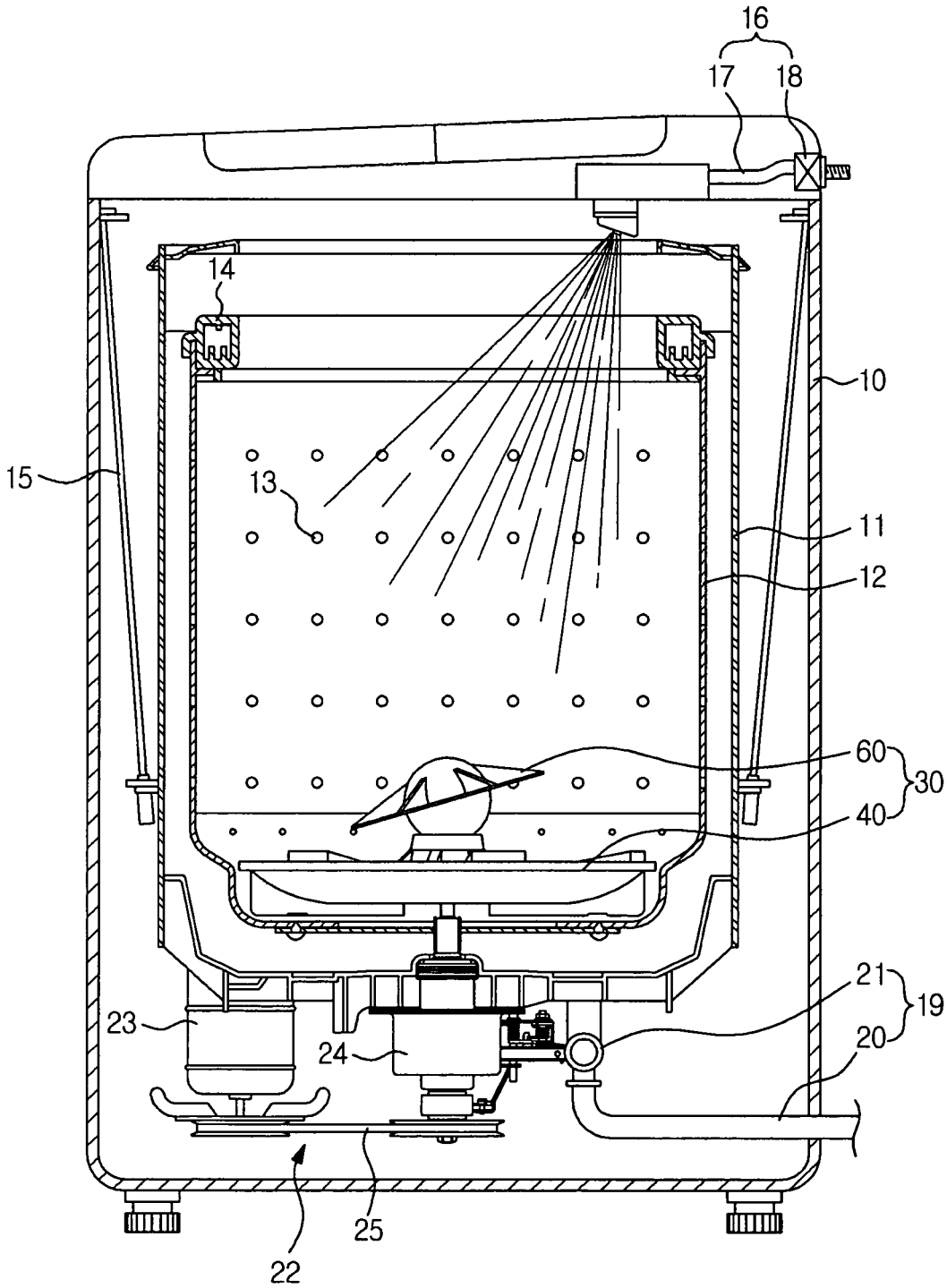
FIG. 1 is a longitudinal-sectional view schematically illustrating a washing machine in accordance with one embodiment.

Reference will now be made in detail to the embodiments of the present invention, examples of which are illustrated in the accompanying drawings, wherein like reference numerals refer to the like elements throughout.

Figure 2:
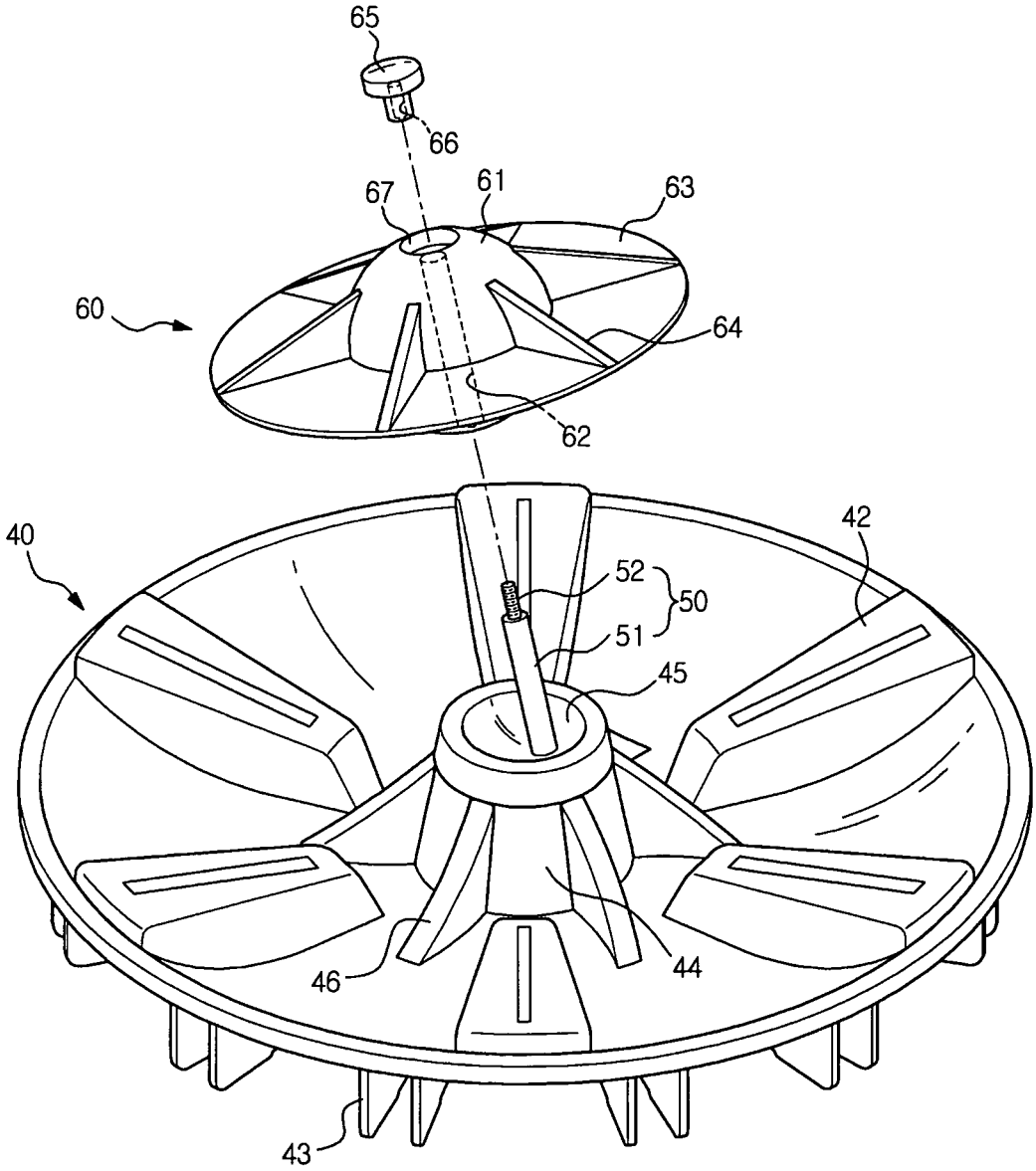
FIG. 2 is an exploded perspective view of a pulsator unit of FIG. 1.
Figure 3:
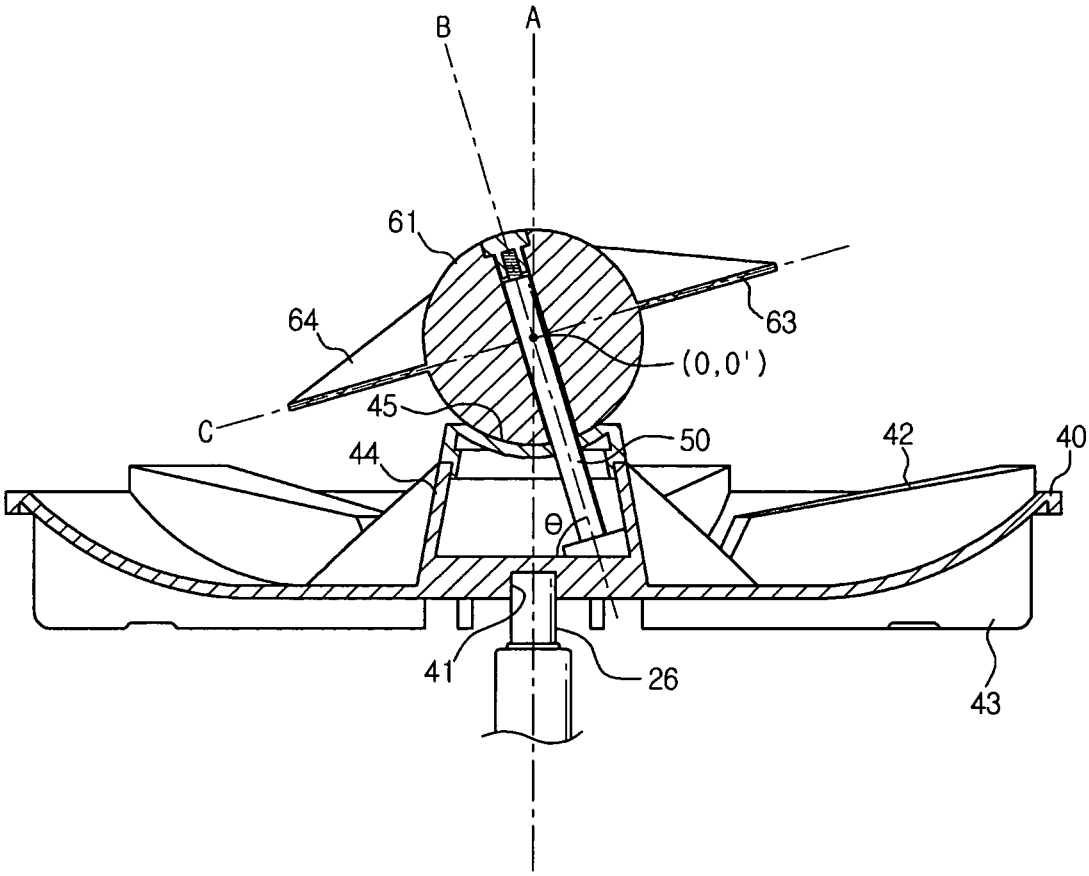
FIG. 3 is a longitudinal-sectional view of the pulsator unit of FIG. 1.
Figure 4:
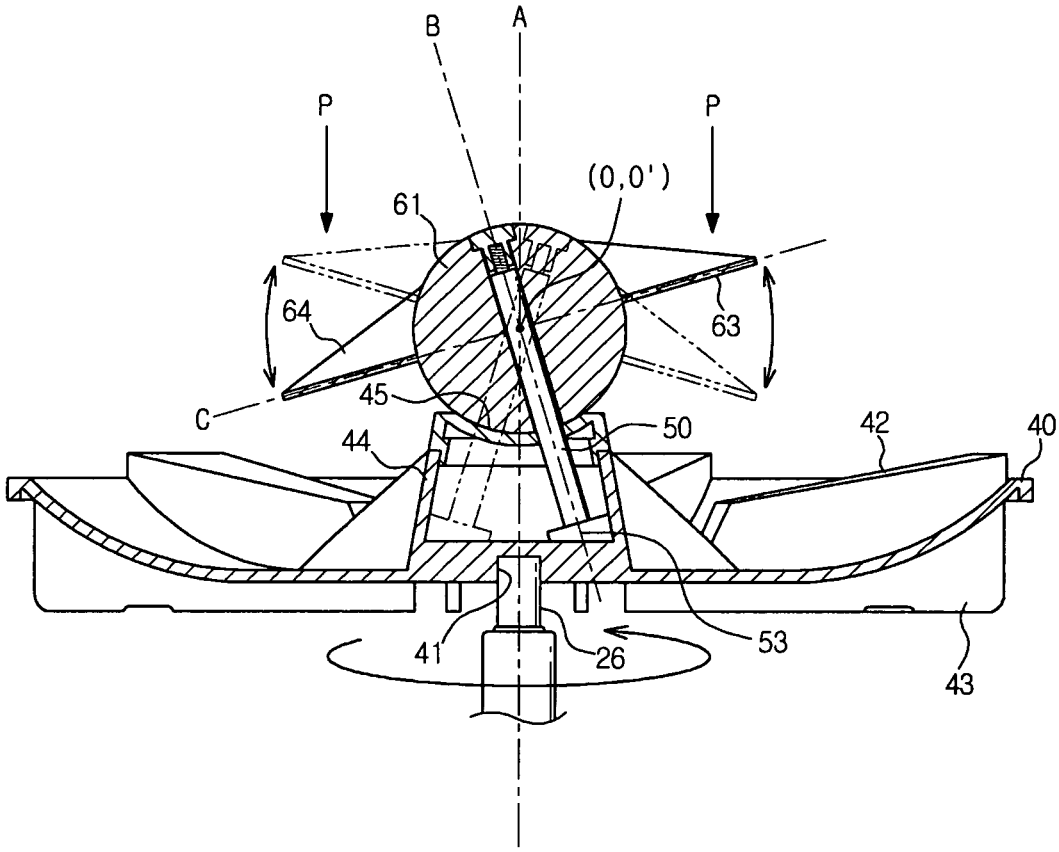
FIG. 4 is a longitudinal-sectional view illustrating the operating state of the pulsator unit of the washing machine in accordance with the embodiment.

FIG. 1 is a longitudinal-sectional view schematically illustrating a washing machine in accordance with one embodiment of the present invention, FIG. 2 is an exploded perspective view of a pulsator unit of FIG. 1, FIG. 3 is a longitudinal-sectional view of the pulsator unit of FIG. 1, and FIG. 4 is a view illustrating the operating state of the pulsator unit of the washing machine in accordance with the embodiment of the present invention.

As shown in FIG. 1, the washing machine in accordance with this embodiment of the present invention includes a tub 11 installed in a main body 10 to contain washing water, a spin basket 12 rotatably installed in the tub 11, and a pulsator unit 30 installed in the spin basket 12 to agitate the washing water and laundry.

The tub 11 is supported by suspension devices 15 under the condition that the lower part the outer surface of the tub 11 is connected to the suspension devices 15 hung onto the upper end of the inside of the main body 10. A water supply device 16 including a water supply pipe 17 and a water supply valve 18 to supply the washing water to the inside of the tub 11 is provided above the tub 11. A drain device 19 including a drain pipe 20, a drain valve 21, and a drain motor (not shown) to discharge the washing water filling the tub 11 to the outside of the washing machine is provided below the tub 11.

The spin basket 12 is formed in a cylindrical shape, the upper surface of which is opened, and a plurality of dehydration holes 13 is formed through the circumferential surface of the spin basket 12. A general balancer 14 to allow the spin basket 12 to stably rotate when the spin basket 12 is rotated at a high speed is installed on the upper part of the spin basket 12.

The pulsator unit 30 includes a first pulsator 40 to form a general rotating water current, which rotates right and left, and a second pulsator 60 connected to the upper surface of the first pulsator 40 to form a wobbling water current, which flows up and down.

The washing machine further includes a driving device 22 to rotate the pulsator unit 30. The driving device 30 in accordance with this embodiment includes a motor 23 installed at the lower portion of the one side of the tub 11, a power transmission device 24 to selectively transmit the rotary force of the motor 23 to the spin basket 12 and the pulsator unit 30, and a belt 25 serving as a medium to transmit power between the motor 23 and the power transmission device 24.

The power transmission device 24 is provided with a general clutch device, which receives the power of the motor 23, and rotates the pulsator unit 30 at a reduced speed or rotates the spin basket 12.

Although this embodiment exemplarily illustrates that the driving device to rotate the pulsator unit applies the power transmission device provided with the clutch device, a direct connection type driving device, in which a pulsator unit is directly rotated by a motor, may be used.

FIG. 2 is an exploded perspective view of the pulsator unit in accordance with the embodiment of the present invention, and FIG. 3 is a longitudinal-sectional view of the pulsator unit.

With reference to FIGS. 2 and 3, the pulsator unit 30 to generate a washing water current includes the first pulsator 40 installed on the bottom surface of the inside of the spin basket 12 to generate a rotating water current, and the second pulsator 60 installed at the upper portion of the first pulsator 40 to generate a rising and falling water current.

The first pulsator 40 has a disc shape, a shaft connection part 41, to which a washing shaft 26 of the driving device 22 is connected, is provided on the lower surface of the first pulsator 40, and rotary blades 42, which protrude in the radial direction, to generate the rotating water current are disposed radially on the upper surface of the first pulsator 40.

Further, rib blades 43 to push the washing water in the spin basket 12 outward are provided on the lower surface of the first pulsator 40 around the shaft connection part 41.

A support member 44 to support the second pulsator 60 is provided at the center of the upper surface of the first pulsator 40, and a seat part 45 having a hemispherical shape is provided at the center of the upper surface of the support member 44.

The support member 44 has a cylindrical shape, protrudes upwardly, and serves to stably support the second pulsator 60 and prevent the collision of the second pulsator 60 with the first pulsator 40 when the second pulsator 60 wobbles.

Reinforcing ribs 46, which are disposed radially to reinforce the stiffness of the first pulsator 40, are provided on the outer circumferential surface of the support member 44.

A rod member 50, which is tilted toward the center of rotation, i.e., a central axis A, of the first pulsator 40 at a designated angle θ, is provided on the upper surface of the first pulsator 40.

The tilt angle θ of the rod member 50 determines the rising and falling range of the second pulsator 60, which wobbles to generate the rising and falling water current.

The rod member 50 has a rod shape, one end of the rod member 50 is connected to the bottom surface of the inside of the support member 44, and the other end of the rod member 50 passes through the seat part 45 formed on the upper surface of the support member 44, crosses the central axis A, and protrudes outward.

A bearing part 51, to which the second pulsator 60 is connected such that the second pulsator 60 is relatively rotatable, is provided on the protruding portion of the rod member 50. The bearing part 51 may include a sliding bearing coming in surface contact with the second pulsator 60 or a rolling bearing coming in indirect contact with the second pulsator 60 to reduce frictional resistance in rotation.

The second pulsator 60, which is installed above the first pulsator 40 to achieve the shaft coupling between the second pulsator 60 and the rod member 50, has a disc shape having a smaller diameter than that of the first pulsator 40. Of course, the second pulsator 60 may have an oval shape, a rectangular shape, or various other shapes.

A rod connection part 61 provided with a bearing hole 62, into which the bearing part 51 of the rod member 50 is inserted, is provided at the center of the second pulsator 60, and a blade part 63 to generate the rising and falling water current is extended from the outer circumferential surface of the rod connection part 61 in the centrifugal direction of the rod connection part 61.

The shape of the rod connection part 61 is not limited, but may be a spherical shape such that the rod connection part 61 is mounted on the hemispherical seat part 45 to stably support the second pulsator 60 when the second pulsator 60 wobbles.

Reinforcing ribs 64, which are disposed radially, are provided on the blade part 63 to reinforce the stiffness of the blade part 63 due to the pressure of the washing water or the load of the laundry.

The blade part 63 may be formed on a wobble axial line C passing through the center of the spherical rod connection part 61. The wobble axial line C is perpendicular to a central axis B of the rod member 50, but is limited thereto.

The center O' of the wobbling motion of the blade part 63 is provided at an intersection O between the central axis A, which is the center of rotation of the first pulsator 40, and the central axis B of the rod member 50.

When the bearing part 51 of the rod member 50 is inserted into the bearing hole 62 of the second pulsator 60, the second pulsator 60 is relatively rotated around the bearing part 51, and thus the rotation of the second pulsator 60 is not transmitted to the rod member 50.

In order to prevent the second pulsator 60 from being separated from the rod member 50 when the second pulsator 60 wobbles, the second pulsator 60 is provided with a separation prevention cap 65 having a screw hole 66, and a cap reception part 67 to receive the separation prevention cap 65.

The separation prevention cap 65 restricts the upward movement of the second pulsator 60 by connecting a screw thread 52 provided on the upper end of the rod member 50 to the screw hole 66 of the separation prevention cap 65 under the condition that the second pulsator 60 is connected to the rod member 50.

FIG. 4 is a longitudinal-sectional view illustrating the operating state of the pulsator unit of the washing machine in accordance with the embodiment. Hereinafter, the operation of the washing machine in accordance this embodiment will be described with reference to FIG. 4.

First, when the washing machine is operated after laundry is put into the spin basket 12, water is supplied to the spin basket 12 and the washing shaft 26 of the driving device 22 is rotated, and thereby the pulsator unit 30 connected to the washing shaft 26 is rotated and forms a washing water current.

That is, the first pulsator 40 connected to the washing shaft 26 is rotated right and left by the rotation of the washing shaft 26 in the regular direction and the reverse direction, and thus generates a rotating water current in the spin basket 12 through the rotary blades 42.

On the other hand, a pressure P pushing the blade part 63 is applied to the second pulsator 60 provided above the first pulsator 40 by the pressure of the washing water or the weight of the laundry supplied to the inside of the spin basket 12.

The rod member 50, which is fixed to the upper surface of the first pulsator 40 such that the rod member 50 is tilted toward the central axis A of the first pulsator 40 at a designated angle θ, is rotated around the central axis A of the first pulsator 40 together with the first pulsator 40.

That is, a trajectory of one end 53 of the rod member 50 fixed to the upper surface of the first pulsator 40 revolves around the central axis A, and thus the position of the rod member 50 is changed.

At this time, the second pulsator 60 wobbles according to the change of the position of the rod member 50 due to the pressure P applied to the blade part 63 of the second pulsator 60 and the relative rotation of the second pulsator 60 against the rod member 50.

That is, the blade part 63 of the second pulsator 60 rises and falls, as shown by the arrow in FIG. 4, according to the rotation of the first pulsator 40, and thereby the washing water forms a wobbling water current flowing up and down.

In this case, when the center O' of the blade part 63 of the second pulsator 60 coincides with the intersection O between the central axis A of the first pulsator 40 and the central axis B of the rod member 50, the blade part 63 of the second pulsator 60 performs a seesaw movement, and thus the second pulsator 60 achieves a more stable wobbling movement.

Figure 5:
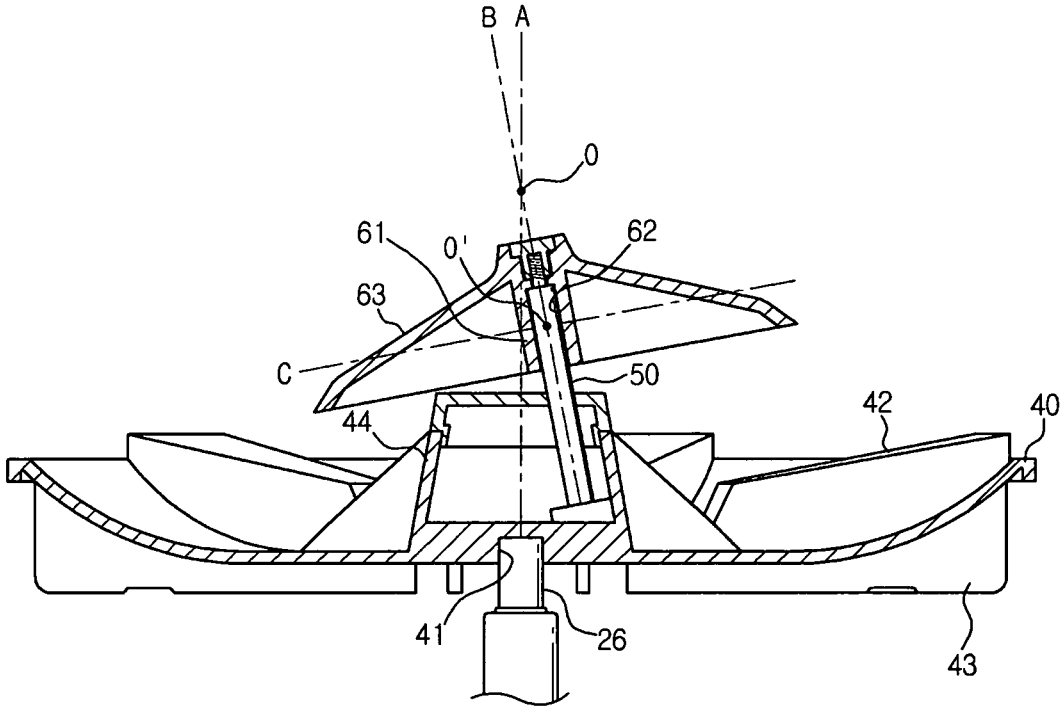
FIG. 5 is a longitudinal-sectional view of a pulsator unit of a washing machine in accordance with another embodiment.
Figure 6:
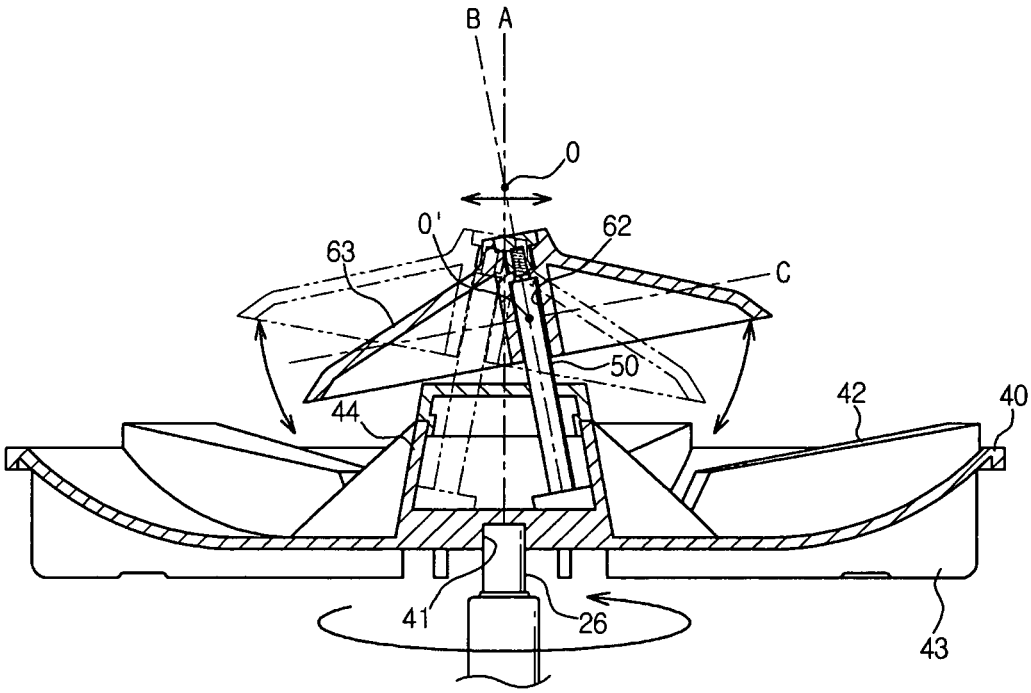
FIG. 6 is a longitudinal-sectional view illustrating the operating state of the pulsator unit of FIG. 5.

FIG. 5 is a longitudinal-sectional view of a pulsator unit of a washing machine in accordance with another embodiment of the present invention, and FIG. 6 is a longitudinal-sectional view illustrating the operating state of the pulsator unit of FIG. 5. Hereinafter, elements in this embodiment, functions of which are substantially same as those in the former embodiment, are denoted by the same reference numerals even though they are depicted in different drawings, and a detailed description thereof will thus be omitted because it is considered to be unnecessary.

As shown in FIG. 5, a rod connection part 61 of a second pulsator 60 connected to the upper portion of a first pulsator 40 to form a wobbling water current flowing up and down has a cylindrical shape having a bearing hole 62 formed therein, and a blade part 63 is extended from the cylindrical outer surface of the rod connection part 61. Further, the rod connection part 61 maintains a separated state from a support member 44 of the first pulsator 40.

The center O' of the wobbling movement of the blade part 63 is separated from a central axis A, which is the center of rotation of the first pulsator 40, by a designated distance.

Thereby, a rod member 50 revolves around the central axis A of the first pulsator 40 at a tilt state according to the rotation of a washing shaft 26 in a regular direction and the reverse direction, as shown in FIG. 6.

In this case, since the center O' of the blade part 63 of the second pulsator 60 rotatably installed on the rod member 50 is deviated from the central axis of the first pulsator 40, the blade part 63 of the first pulsator 40 moves right and left and simultaneously moves up and down together with the rotation of the rotation of the rod member 50.

Therefore, the washing water current generated in the spin basket 12 is a combined current, and thus more effectively prevents the twisting or entanglement of the laundry.

Figure 7:
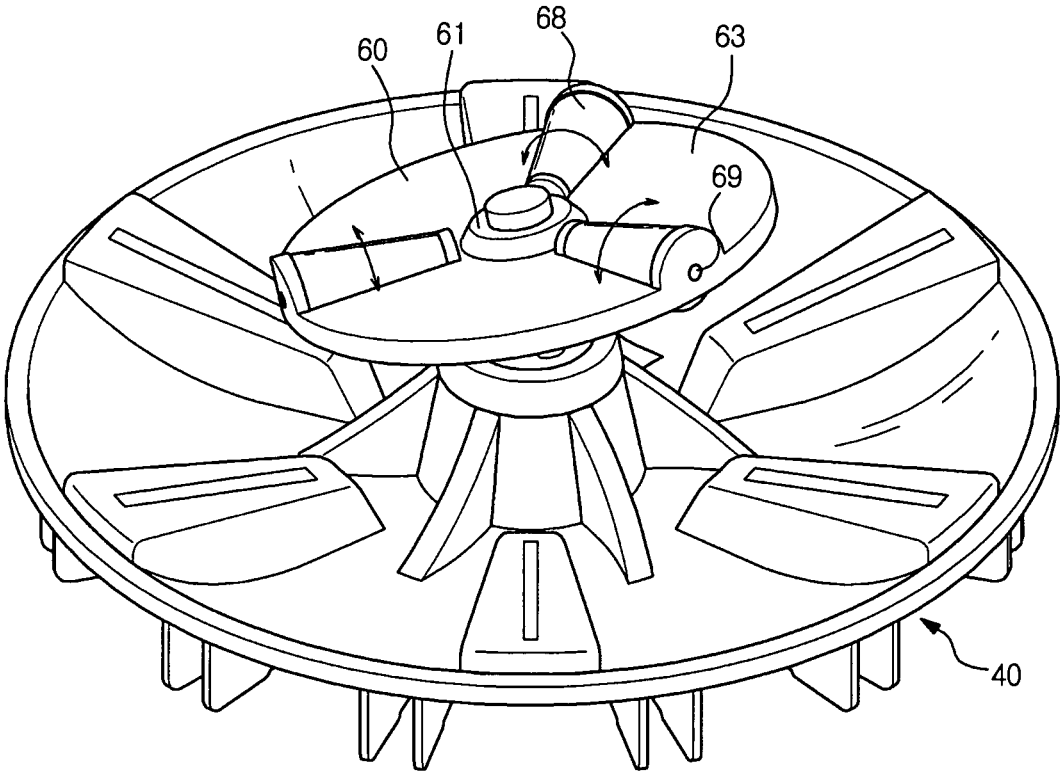
FIG. 7 is a longitudinal-sectional view of a pulsator unit of a washing machine in accordance with a further embodiment.

FIG. 7 is a longitudinal-sectional view of a pulsator unit of a washing machine in accordance with a further embodiment. As shown in FIG. 7, roller members 68 are provided on a blade part 63 of a second pulsator 60 installed above a first pulsator 40 to generate a rising and falling water current.

The roller members 68 are respectively connected to rotary shafts 69, and are freely rotated. Further, the roller members 68 are disposed radially around a rod connection part 61, and the diameter of the roller members 68 is increased as the roller members 68 approach the edge of the blade part 63.

Thereby, when laundry is mounted on the blade part 63 of the second pulsator 60, the laundry is raised or dropped by the roller members 68.

Therefore, washing water in the spin basket 12 generates a combined water current obtained by the interference among a rotating water current by the first pulsator 40, a rising and falling water current by the second pulsator 60, and a rising and falling water current generated when the laundry moves along the roller members 68, and thus the washing efficiency of the washing machine is further improved.

As is apparent from the above description, the pulsator unit for washing machines in accordance with one embodiment of the present invention and the washing machine having the same generate a combined water current through a simple mechanical structure, thus improving productivity.

Further, the combined water current reduces the twisting and entanglement of laundry, and further reduces the amount of consumed washing water.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A pulsator unit for washing machines to generate a washing water current comprising:

a first pulsator connected to a washing shaft of the washing machine, the first pulsator including rotary blades which protrude in a radial direction to generate a rotating water current;

a rod member installed on the upper surface of the first pulsator such that the rod member is tilted against the washing shaft and rotates in conjunction with the first pulsator, the rod member being tilted toward a central axis of the first pulsator; and a second pulsator shaft-coupled with the rod member such that the second pulsator is relatively rotated against the rod member, wherein a designated angle of the rod member determines a rising and falling range of the second pulsator so that the second pulsator generates a rising and falling water current, and a center of a wobbling movement of the second pulsator is formed at the intersection between the central axis of the first pulsator and a central axis of the rod member.

2. The pulsator unit according to claim 1, wherein the diameter of the second pulsator is smaller than that of the first pulsator.

3. The pulsator unit according to claim 1, wherein the center of the wobbling movement of the second pulsator is separated from the central axis of the first pulsator by a designated distance.

4. A pulsator unit for washing machines to generate a washing water current comprising:

a first pulsator connected to a washing shaft of the washing machine, the first pulsator including rotary blades which protrude in a radial direction to generate a rotating water current;

a rod member installed on the upper surface of the first pulsator such that the rod member is tilted against the washing shaft and rotates in conjunction with the first pulsator, the rod member being tilted toward a central axis of the first pulsator; and a second pulsator shaft-coupled with the rod member such that the second pulsator is relatively rotated against the rod member, wherein a designated angle of the rod member determines a rising and falling range of the second pulsator so that the second pulsator generates a rising and falling water current, a bearing part is formed on the rod member, and a bearing hole contacting the bearing part is formed on the second pulsator.

5. A pulsator unit for washing machines to generate a washing water current comprising:

a first pulsator connected to a washing shaft of the washing machine, the first pulsator including rotary blades which protrude in a radial direction to generate a rotating water current;

a rod member installed on the upper surface of the first pulsator such that the rod member is tilted against the washing shaft and rotates in conjunction with the first pulsator, the rod member being tilted toward a central axis of the first pulsator; and a second pulsator shaft-coupled with the rod member such that the second pulsator is relatively rotated against the rod member, wherein a designated angle of the rod member determines a rising and falling range of the second pulsator so that the second pulsator generates a rising and falling water current, a bearing part is formed on the rod member, and a support member to support the second pulsator and pass the rod member is provided at the center of the first pulsator, and the bearing part is formed at a part protruding from the support member.

6. A pulsator unit for washing machines to generate a washing water current comprising:

a first pulsator connected to a washing shaft of the washing machine, the first pulsator including rotary blades which protrude in a radial direction to generate a rotating water current;

a rod member installed on the upper surface of the first pulsator such that the rod member is tilted against the washing shaft and rotates in conjunction with the first pulsator, the rod member being tilted toward a central axis of the first pulsator; and a second pulsator shaft-coupled with the rod member such that the second pulsator is relatively rotated against the rod member, wherein a designated angle of the rod member determines a rising and falling range of the second pulsator so that the second pulsator generates a rising and falling water current, and the second pulsator includes a rod connection part provided with a bearing hole, into which the rod member is inserted, and a blade part extended from the outer surface of the rod connection part.

7. The pulsator unit according to claim 6, wherein reinforcing ribs to reinforce the stiffness of the blade part are provided on the second pulsator.

8. The pulsator unit according to claim 6, wherein the rod connection part has a spherical shape.

9. The pulsator unit according to claim 8, wherein a support member provided with a seat part having a semispherical shape to support the rod connection part is provided at the center of the first pulsator.

10. The pulsator unit according to claim 6, wherein roller members are provided on the blade part.

11. A washing machine, which has a tub installed in a main body to contain washing water, a spin basket rotatably installed in the tub, and a pulsator unit installed in the spin basket to generate a washing water current, the pulsator unit comprising:

a first pulsator connected to a washing shaft of a driving device;

a rod member installed on the upper surface of the first pulsator such that the rod member is tilted toward a central axis of the first pulsator against the washing shaft and rotates in conjunction with the first pulsator; and a second pulsator coupled with the rod member such that the second pulsator is relatively rotated against the rod member, wherein a bearing part is formed on the rod member, and a bearing hole contacting the bearing part is formed on the second pulsator.

12. The washing machine according to claim 11, wherein the second pulsator includes a rod connection part provided with the bearing hole, and a blade part extended from the outer surface of the rod connection part.

13. The washing machine according to claim 12, wherein a support member to support the rod connection part is provided at the center of the first pulsator.

14. The washing machine according to claim 13, wherein the rod connection part has a spherical shape, and a seat part having a semispherical shape, on which the rod connection part is seated, is provided on the upper surface of the support member.

15. The washing machine according to claim 14, wherein the blade part is perpendicular to a central axis of the rod member.

16. The washing machine according to claim 12, wherein roller members are provided on the blade part of the second pulsator.

17. A washing machine, which has a tub installed in a main body to contain washing water, a spin basket rotatably installed in the tub, and a pulsator unit installed in the spin basket to generate a washing water current, the pulsator unit comprising:

a first pulsator connected to a washing shaft of a driving device;

a rod member installed on the upper surface of the first pulsator such that the rod member is tilted toward a central axis of the first pulsator against the washing shaft and rotates in conjunction with the first pulsator; and a second pulsator coupled with the rod member such that the second pulsator is relatively rotated against the rod member, wherein the center of the wobbling movement of the second pulsator is formed at the intersection between the central axis of the first pulsator and a central axis of the rod member.

18. A washing machine, which has a tub installed in a main body to contain washing water, a spin basket rotatably installed in the tub, and a pulsator unit installed in the spin basket to generate a washing water current, the pulsator unit comprising:

a first pulsator connected to a washing shaft of a driving device;

a rod member installed on the upper surface of the first pulsator such that the rod member is tilted toward a central axis of the first pulsator against the washing shaft and rotates in conjunction with the first pulsator; and a second pulsator coupled with the rod member such that the second pulsator is relatively rotated against the rod member, wherein the center of the wobbling movement of the second pulsator is separated from the central axis of the first pulsator by a designated distance.

* * * * *